US008677960B2

(12) United States Patent
Knecht et al.

(10) Patent No.: US 8,677,960 B2
(45) Date of Patent: Mar. 25, 2014

(54) CAMSHAFT ADJUSTER, IN PARTICULAR WITH CAMSHAFT

(75) Inventors: Andreas Knecht, Kusterdingen (DE); Sebastian Borchelt, Schoeneiche (DE); Dirk Pohl, Kirchentellinsfurt (DE)

(73) Assignee: Hilite Germany GmbH, Marktheidenfeld (DE)

( * ) Notice: Subject to any disclaimer, the term of this patent is extended or adjusted under 35 U.S.C. 154(b) by 294 days.

(21) Appl. No.: 13/136,570

(22) Filed: Aug. 3, 2011

(65) Prior Publication Data

US 2012/0031358 A1 Feb. 9, 2012

(30) Foreign Application Priority Data

Aug. 4, 2010 (DE) ..... 10 2010 033 296

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS

| | | | |
|---|---|---|---|
| 2,911,956 | A | 11/1959 | Smith, Jr. et al. |
| 4,332,222 | A | 6/1982 | Papez |
| 5,233,948 | A | 8/1993 | Boggs et al. |
| 5,235,939 | A | 8/1993 | Levin et al. |
| 6,076,492 | A | 6/2000 | Takahashi |
| 6,253,719 | B1 | 7/2001 | Methley |
| 6,510,827 | B2 | 1/2003 | Schreeck et al. |
| 6,546,842 | B2 | 4/2003 | Raikamo |
| 6,725,817 | B2 | 4/2004 | Methley et al. |
| 6,814,036 | B2 | 11/2004 | Palesch et al. |
| 6,832,583 | B2 | 12/2004 | Hayman |
| 6,945,205 | B2 | 9/2005 | Heintzen et al. |
| 7,004,130 | B2 | 2/2006 | Bolz et al. |
| 7,270,096 | B2 | 9/2007 | Lancefield et al. |
| 7,284,517 | B2 | 10/2007 | Lancefield et al. |
| 7,287,499 | B2 | 10/2007 | Lawrence et al. |
| 7,503,293 | B2 | 3/2009 | Lettmann et al. |
| 7,610,890 | B2 | 11/2009 | Lettmann et al. |
| 7,841,311 | B2 | 11/2010 | Hutcheson et al. |
| 2002/0059910 | A1 | 5/2002 | Methley et al. |
| 2002/0096044 | A1 | 7/2002 | Raikamo |
| 2002/0104497 | A1 | 8/2002 | Schreeck et al. |
| 2003/0177991 | A1 | 9/2003 | Palesch et al. |
| 2004/0226524 | A1 | 11/2004 | Hayman |
| 2005/0109298 | A1 | 5/2005 | Bolz et al. |
| 2006/0185471 | A1 | 8/2006 | Lawrence et al. |

(Continued)

FOREIGN PATENT DOCUMENTS

| | | |
|---|---|---|
| DE | 36 24 827 | 2/1988 |
| DE | 43 32 868 | 3/1995 |

(Continued)

*Primary Examiner* — Ching Chang
(74) *Attorney, Agent, or Firm* — Lipsitz & McAllister, LLC

(57) ABSTRACT

A valve train comprises a double camshaft with an inner camshaft and an outer camshaft. The two camshafts are preferably designed coaxially. By means of a rotatory change in position of the inner camshaft to the outer camshaft, the angular position of at least one cam of the inner camshaft is adjusted or set relative to a cam of the outer camshaft. The cams are divided into sets that can occupy variable cam positions relative to one another. Various configurations of a camshaft adjuster are provided for this purpose.

8 Claims, 9 Drawing Sheets

(56) References Cited

U.S. PATENT DOCUMENTS

| | | | |
|---|---|---|---|
| 2007/0034182 | A1 | 2/2007 | Dengler |
| 2007/0039411 | A1 | 2/2007 | Lechner et al. |
| 2007/0240657 | A1 | 10/2007 | Schneider |
| 2008/0257290 | A1 | 10/2008 | Lettmann et al. |
| 2009/0173297 | A1* | 7/2009 | Hutcheson et al. |
| 2009/0183702 | A1 | 7/2009 | Knecht et al. |
| 2009/0223470 | A1 | 9/2009 | Rozario et al. |

FOREIGN PATENT DOCUMENTS

| | | |
|---|---|---|
| DE | 199 14 909 | 10/2000 |
| DE | 101 02 767 | 7/2002 |
| DE | 10 2004 023 451 | 12/2004 |
| DE | 10 2004 024 222 | 3/2005 |
| DE | 103 46 446 | 5/2005 |
| DE | 103 46 448 | 6/2005 |
| DE | 10 2005 014 680 | 8/2006 |
| DE | 10 2008 033 230 | 7/2009 |
| EP | 0 397 540 | 11/1990 |
| EP | 1 234 954 | 8/2002 |
| EP | 1 347 154 | 9/2003 |
| EP | 1 696 107 | 8/2006 |
| JP | 11173120 | 6/1999 |
| WO | 92/12333 | 7/1992 |
| WO | 01/12996 | 2/2001 |
| WO | 2005/040562 | 5/2005 |

* cited by examiner

CAMSHAFT ADJUSTER, IN PARTICULAR WITH CAMSHAFT

This application claims the benefit of German patent application number DE 10 2010 033 296.8 filed on Aug. 4, 2010, which is incorporated herein by reference in its entirety and for all purposes.

BACKGROUND OF THE INVENTION

The present invention relates to a valve train of an internal combustion engine with a double camshaft.

A rotary drive that is specifically made for an adjusting shaft of a variable valve train is known from EP 1 347 154 A2 (Applicant: Hydraulik-Ring GmbH; Priority date: Mar. 20, 2003). A first rotatory hydraulic drive is joined to a second rotatory hydraulic drive so that coarse and fine adjustments of an exact cam position within a valve train chain are possible. In other words, the rotary angle position to be adjusted is made possible by a two-stage system.

U.S. Pat. No. 2,911,956 (Applicant: Smith; Date filed: Jan. 7, 1959) describes a plate-type positioner, by means of which a pivoting movement of a first plate influences the pivoting range of a second plate, and so forth.

WO 01/12996 A1 (Applicant: Raikamo; Priority date: Aug. 17, 1999) shows in FIG. 5a a two-stator shaft adjusting system, in which the rotor is limited in its pivoting range by the rotation of a first and a second stator.

One skilled in the art can derive from U.S. Pat. No. 5,233,948 (Applicant: Ford Motor Corporation; Date filed: Dec. 10, 1992) the advantages that can be found if the cams of superimposed camshafts can be adjusted relative to one another. Thus there has been the desire for several years to create valve trains that are configured so that they can individually control the events of several gas-exchange valves of a combustion chamber. The theoretical advantages can be derived from the Ford patent, but there is a lack of transferring these advantages to concrete proposals. By this reference, the principles theoretically disclosed in the Ford patent will apply as incorporated to the full extent in the present description of the invention.

Approaches for executing the teaching of U.S. Pat. No. 5,233,948 are known from FIGS. 4A to 4C of U.S. Pat. No. 5,235,939 (Applicant: Ford Motor Company; Date filed: Nov. 5, 1992), which illustrate a coaxial double camshaft with at least two sets of cams offset at an angle relative to one another, the cams of which are attached by fastening pins and fastening springs to the particular camshafts bearing them. A similar arrangement is known from WO 2005/040562 A1 (Applicant: Audi AG; Priority date: Oct. 25, 2003). According to the description, the position of the cams will be adjusted with hydraulic linear cylinders. A similar construction is known from FIG. 1 of DE 43 32 868 A1 (Applicant: BMW AG; Date filed: Sep. 27, 1993), which will also adjust the cam position of an intake cam to an exhaust cam by a linear movement. The representation in EP 0 397 540 A1 (Applicant: Regie Nationale des Usines Renault; Priority date: Mar. 17, 1989) also shows a linear-adjustable camshaft arrangement. A contour-fitted run-in pin, which influences via its surface the angular distance between two cams and thus the relative positions of the camshafts associated with these is known from FIGS. 5 and 6 of U.S. Pat. No. 4,332,222 (Applicant: Volkswagen AG; Priority date: May 20, 1978). Two hollow-shaft camshafts that engage in one another can be adjusted in their angular position relative to one another via a planetary gear with lengthwise holes according to the unexamined German application DE 36 24 827 A1 (Applicant: Süddeutsche Kolbenbolzenfabrik GmbH; Date filed: Jul. 23, 1986). In order to conform to present exhaust limit values in high-compression internal combustion engines, however, the outer shaft must also be adjustable relative to the drive shaft, particularly the crankshaft. Another basic concept for the creation of a nested cam contour can be derived from DE 199 14 909 A1 (Applicant: BMW AG; Date filed: Apr. 1, 1999). The cam contour of the principal cam of a camshaft can be widened with an auxiliary cam, in order to control the associated gas-exchange valve a second time, offset in time relative to the main event, and to thus make possible a boosting of the ejection or another ejection from the cylinder.

Another operating mode of a camshaft with adjustable double cam events is described in DE 10 2004 023 451 A1 (Applicant: General Motors Corp.; Priority date: May 16, 2003). Finally, the following two publications will be named: JP 11 17 31 20 (Applicant: Mitsubishi Motors Corp; Date filed: Dec. 8, 1997) and WO 1992/012 333 (Applicant: Porsche AG; Priority date: Jan. 12, 1991).

In summary, it can be seen that the following has been considered for many years: How can events in the gas-exchange valve train that are offset in time relative to one another be made adjustable in their phase positions?

DE 10 2005 014 680 A1 (Applicant: Mahle International GmbH, Priority date: Feb. 3, 2005) shows in several graphic representations a double camshaft that is equipped with a connected, grooved oil delivery unit in order to be able to further conduct the hydraulic oil to a hydraulic adjuster, which is not shown. Representatives of the Applicant company, Mahle International GmbH, presented technical descriptions of double camshafts that are described basically in DE 10 2005 014 680 A1 at the 16$^{th}$ Aachen Colloquium on Vehicle and Engine Technology 2007, showing figures and functional diagrams. As it was established at the colloquium, those skilled in the art have still not been able to successfully terminate their quest for suitable camshaft adjusters for appropriate double camshafts.

A camshaft adjuster for the relative rotating of a hollow camshaft and a second rotatable member disposed parallel to the first rotatable member is described in U.S. Pat. No. 6,253,719 B1 (Patent proprietor: Mechadyne PLC, Priority date: Feb. 18, 1999). Instead of arranging the two rotatable members with a type of disk structure next to one another, in the figures of U.S. Pat. No. 6,725,817 B2 (Patent proprietor: Mechadyne PLC, Priority date: Nov. 18, 2000), different embodiments of a nested adjuster lying in the same plane can be seen, whose first adjusting element can rotate a first set of cams of the concentric camshaft, while the second adjusting element is specific for the purpose of rotating a second set of cams of the concentric camshaft. In this way, the angular rotation of one set of cams influences the accessible angular region of the other set of cams. A similar presentation can also be taken from EP 1 234 954 A2 (Applicant: Mechadyne PLC, Priority date: Nov. 18, 2000). On the other hand, it would be more favorable if the sets of cams of the double camshaft could be adjusted as much as possible independently of one another in a further, larger adjustment range.

A type of connection for a double camshaft can be derived from EP 1 696 107 A1 (Applicant: Mechadyne PLC, Priority date: Feb. 23, 2005), in which both a camshaft adjuster as well as also an individual cam can be joined to the double-design camshaft by the use of cross-running pins. In this case, the pin is to be fitted with play in the crossbore of the camshaft.

The statement of the problem in U.S. Pat. No. 6,076,492 (Applicant: Yamaha Hatsudoki Kabushiki Kaisha, Priority date: Mar. 27, 1998) explains that in simply constructed camshaft adjusters of an axial displaceable type, there is a problem only in permanently aligning the camshaft adjuster, the cylinder head, the control valve and the camshaft in a stationary manner. Even for sufficiently known camshaft adjusters, there is a fear of jamming the individual components relative to one another.

Rotors with a broadened base are known from the publications DE 103 46 446 A1 and DE 103 46 448 A1 (Applicant: Daimler-Chrysler AG; Date filed: Oct. 7, 2003), the bases of which are fanned out opposite the vane width for reasons of stability or for conducting oil.

How camshaft adjusters can be connected to divided camshafts is shown in the drawings of DE 101 02 767 A1 (Applicant: Volkswagen AG; Date filed: Jan. 23, 2001). Each camshaft controls one type of gas-exchange valve. Thus, there is a camshaft adjuster for the gas inlet valves and a camshaft adjuster for the gas outlet valves. Each camshaft adjuster is disposed on the half of the camshaft belonging to it.

The presented embodiments of two gas-exchange valve actuation means that can be displaced or adjusted relative to one another in a control shaft are incorporated by their reference within the scope of the present description of invention, in order to increase the readability of the description of the invention in this way and thus to be able to emphasize the aspects of the present invention given below. The scope of their disclosure will be fully incorporated by their reference in the present description.

A gas-exchange valve control shaft, which is constructed from two camshafts that are disposed so that they engage in each other, preferably coaxially, the outer camshaft surrounding the inner camshaft, is also occasionally called a double camshaft. A double camshaft is a camshaft that is constructed in duplicate. Persons skilled in the art associate the term camshaft most frequently to a single shaft extending lengthwise on which all cams are disposed in a stationary manner relative to one another.

The problem to be solved by the present invention is to create a means by which a camshaft adjuster can be joined to a corresponding camshaft in order to operate the valve train of an internal combustion engine in a reliably flexible and optionally repeatedly exchangeable manner. Ideally, the camshaft adjuster can be adjusted or aligned to the camshaft during assembly. The individual groups of cams and the individual cams are to be reliably aligned to one another, to the remaining cams and groups of cams, particularly in the case of a double camshaft.

SUMMARY OF THE INVENTION

The technical problem will be solved by a device according to the present invention. Advantageous example embodiments can be derived from the description below.

A rotor, which is disposed in a specific angular range and can be moved between crosspieces of a stator that can also be configured as a part of the surrounding housing, can also be called a rotating vane. The term rotating vane refers rather to the vane-type construction of the central, middle, pivoting camshaft connecting member which is frequently referred to as the driven member, whereas the term rotor refers rather to the rotating property of the driven member in contrast to otherwise conventional axial-linear adjusting elements.

The camshaft adjuster is a part of a variable valve train of an internal combustion engine. The internal combustion engine has at least one gas-exchange valve control shaft. The gas-exchange valve control shaft has two concentrically disposed camshafts, which can be adjusted in a rotary manner relative to one another, i.e., at least two cams can be angularly rotated relative to one another. The camshaft is set in a relative relationship to a reference shaft that is dependent on the angle of rotation. It is particularly advantageous if the two camshafts can be considered as camshafts that are independent of one another. Each camshaft has a maximum angular range, which can be swept over independently of the other camshaft.

For reasons of exhaust technology, the valve train of an internal combustion engine is frequently constructed with a camshaft and a pivoting-rotor camshaft adjuster for changing the relative position of the camshaft to a second shaft. The second shaft is a crankshaft or drive shaft. The camshaft adjuster at least has the rotation components of a rotor and a stator. The components can be referred to as rotation components, since they can be variably rotated relative to one another and thus can assume different phase relationships relative to one another. Hydraulic chambers with variable, particularly opposite-running volumes, are formed between the rotor components. The respective chamber is larger or smaller due to a pivoting-rotor movement. At least one of the rotation components is joined to the camshaft by a pin engaging in the camshaft in such a way that positional changes of the rotor relative to the stator are transferred onto the camshaft by the pin or by a pin-like joining means. It has been shown, especially for double camshafts, that very long extended camshafts tend toward jamming and sticking. The invention proposes a solution in which the additional jamming can be reduced by a connected camshaft adjuster. Also, the connection will be produced rapidly and reliably during the assembly process. The connection can also be dismantled. The connection permits adjusting the camshaft relative to the camshaft adjuster.

The adjuster operating in a pivoting-rotor manner is also occasionally called an adjuster operating as a pivoting motor, although it is not a motor function that is carried out, but only a selection of position by means of the camshaft adjuster, operating particularly according to the rotating vane principle.

In accordance with an example embodiment of the present invention, the valve train comprises a double camshaft with an inner camshaft and an outer camshaft. The two camshafts are preferably designed coaxially. By means of a rotatory change in position of the inner camshaft to the outer camshaft, the angular position of at least one cam of the inner camshaft is adjusted or set relative to a cam or the outer camshaft. Advantageously, the cam of the inner camshaft is mounted on the outer camshaft, bound by means of a pin to the inner camshaft, so that it can pivot. The larger bearing surface of the outer camshaft can be utilized, while the event position of the valve train is made possible by an adjustment of the inner camshaft that possesses less mass.

The valve train can be adjusted variably to a reference shaft. The valve train comprises at least two camshafts. The valve train has at least one first camshaft and one second camshaft. The camshafts are disposed in .such a way that two of the camshafts are present as a coaxially configured double camshaft. The double camshaft is observed from the outside as a unified camshaft, the cams of which can be adjusted differently. The cams are divided into sets, which can occupy cam positions that are variable relative to one another. There is a camshaft adjuster for this purpose. The camshaft adjuster is preferably a pivoting-rotor camshaft adjuster. The camshaft adjuster is attached by its center to one of the two camshafts with a first set of rotatable components by a connection means that passes through the center of the camshaft adjuster and engages to a first (inner) of the two camshafts, the connection means comprising one of a screw or a central valve. The camshaft adjuster has different sets of components that are rotatable relative to one another, such as a rotor with vanes, at least one locking pin and oil conducting channels. A maximum radius is formed by a rim-type mounting flange to the second (outer) camshaft. There is at least one additional connecting means inside the radius that passes through the camshaft adjuster and engages the mounting flange. This additional connection means can be a screw. Ideally, there are several of such additional connection means that pass through and engage the mounting flange of the second camshaft second set of rotatable components of the camshaft adjuster. One part of the camshaft adjuster is rotatory concurrently with the first camshaft. The other part of the camshaft adjuster is rotatory concurrently with the second camshaft. A double camshaft can be conveniently, reliably and rapidly connected to a suitable camshaft adjuster in this manner.

In a valve train according to an example embodiment of the invention, the mounting flange can be shaped in one piece to the outside of the two camshafts. The outer camshaft can thus be a forged camshaft. The mounting flange is formed radially outward at one end of the camshaft. The screws can be introduced into the mounting flange in several places around it. The screws engage for a form-fit connection. Torque is introduced uniformly on the camshaft. The torque introduced on the camshaft adjuster via the driving force of the valve train, such as, for example, the chain drive, can thus be transferred to the entire outer camshaft.

The camshaft adjuster comprises a first set of rotatable components. A rotor may belong to the first set. The rotor serves for the formation of hydraulic chambers together with at least one additional component of the camshaft adjuster, such as a stator. The stator belongs to the second set of rotatable components. A free cut space is provided in one of the parts of the component sets. The free cut space is disposed in alignment with the orientation of the camshaft. A long, easy-to-attach component is formed. The at least one free cut space serves for the uptake of the connection means to be aligned axially to the camshaft. The type of fastening of camshaft adjuster and double camshaft according to the present invention requires no additional space for the connection means. The mounting flange can simultaneously serve as a bearing.

The free cut space in the camshaft adjuster has a certain length. The length of the free cut space is based on a complete removal of the connection means from the mounting flange. The diameter of the free cut space is larger than the widest place on the connection means. The free cut space transitions into a narrow-mouth guide channel. The narrow-mouth guide channel has an opening size that allows the fastening means that passes through to engage with as little play as possible. The free cut space narrows to a guide channel. The guide channel has the form of the back of the throat; it has narrow opening. The guide channel provides the access opening for a manipulating means. The manipulating means during fastening can be a screwdriver bit.

The outer, enveloping component of the camshaft adjuster, such as, for example, the stator, is equipped with a free cut space in one example embodiment. The free cut space can simultaneously represent an oil chamber. During operation, the hydraulic fluid can penetrate into the free cut space. A portion of the connection means that passes through the camshaft adjuster and engages with the mounting flange is to be lowered in the free cut space. During the phase when the camshaft adjuster is joined with the camshaft, the free cut space is utilized by the one or more connection means. No additional mounting space needs to be available.

The additional one or more connection means that pass through the camshaft adjuster and engage with the mounting flange is or are located within a radius. The imaginary radius or radius to be formed runs inside the camshaft adjuster. The radius is also disposed centrally around the central fastening means. The radius is smaller than the inner wall of the stator. In one example embodiment, the radius may be as small as possible, e.g., at a maximum, as large as the rotor core. All connection means are found in the center of the camshaft adjuster. The inertia of the camshaft adjuster is reduced in this way.

In another embodiment, the additional connection means that pass through and engage can be located in crosspiece-type sections of the enveloping part of the camshaft adjuster. They can also be partially placed in the crosspiece-type sections. The connection means or the screws can be located both partially in the crosspieces and partially outside-the crosspieces, thus, e.g., in the hydraulic chambers.

If the different types of connection means are oriented in opposite directions, then the connection means can be introduced from different sides into the camshaft adjuster and the valve train. The same side of the camshaft adjuster is not always perforated.

The camshaft adjuster has at least one trough-like configured recess in the crosspiece-type sections. Preferably, each crosspiece has a trough-like recess. The recesses may be present for expanding or widening the hydraulic chambers. The head of the additional connection means that passes through the camshaft adjuster and engages the mounting flange of the second camshaft can rest therein in form-fitting fashion by its side associated with the camshaft. Any material weakness worthy of note does not need to be considered if the hydraulic chambers transition into the recesses.

The camshaft adjuster that can be used particularly in a valve train according to an example embodiment of the invention has at least one rotor and at least one stator. In an alternative example embodiment, the camshaft adjuster has at least two rotors and one stator. Rotor and stator are rotatable together. The stator and the at least one rotor form hydraulic chambers that run opposite to one another and can be braced differently. The sizes of the hydraulic chambers are formed by a pivoting-rotor movement of the rotor. The camshaft adjuster is equipped with a central connection means that passes through the camshaft adjuster and engages with the first camshaft, for fastening to a double camshaft. The rotor has at least one free cut space. The free cut space is adapted in its dimensions to another connection means for fastening the stator to one of the two camshafts of the double camshaft for possible disassembly. An easy-to-mount compact unit is nevertheless formed from the camshaft adjuster and the double-design camshaft, the double camshaft.

According to one aspect, the invention is characterized in that even high torques can be transferred. A double camshaft can be driven with a previously known, conventional pivoting-rotor camshaft adjuster, if connection means of the second type are provided at the locations designated according to the invention inside the camshaft adjuster. All the trials and extensive experience over many years from the field of pivoting-rotor camshaft adjusters can be transferred to the valve train with a double camshaft. A double camshaft permits adjusting an event, thus modifying the opening and closing behavior of the gas-exchange valves, within a single valve train.

BRIEF DESCRIPTION OF THE DRAWINGS

The present invention will hereinafter be described in conjunction with the appended drawing figures, wherein like reference numerals denote like elements, and.

Similar objects and functionally equivalent parts are disclosed by the same reference characters in all embodiment examples (increased by 200 in each case) for aiding in understanding, although slight differences may be indicated between the individual embodiments.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1B:
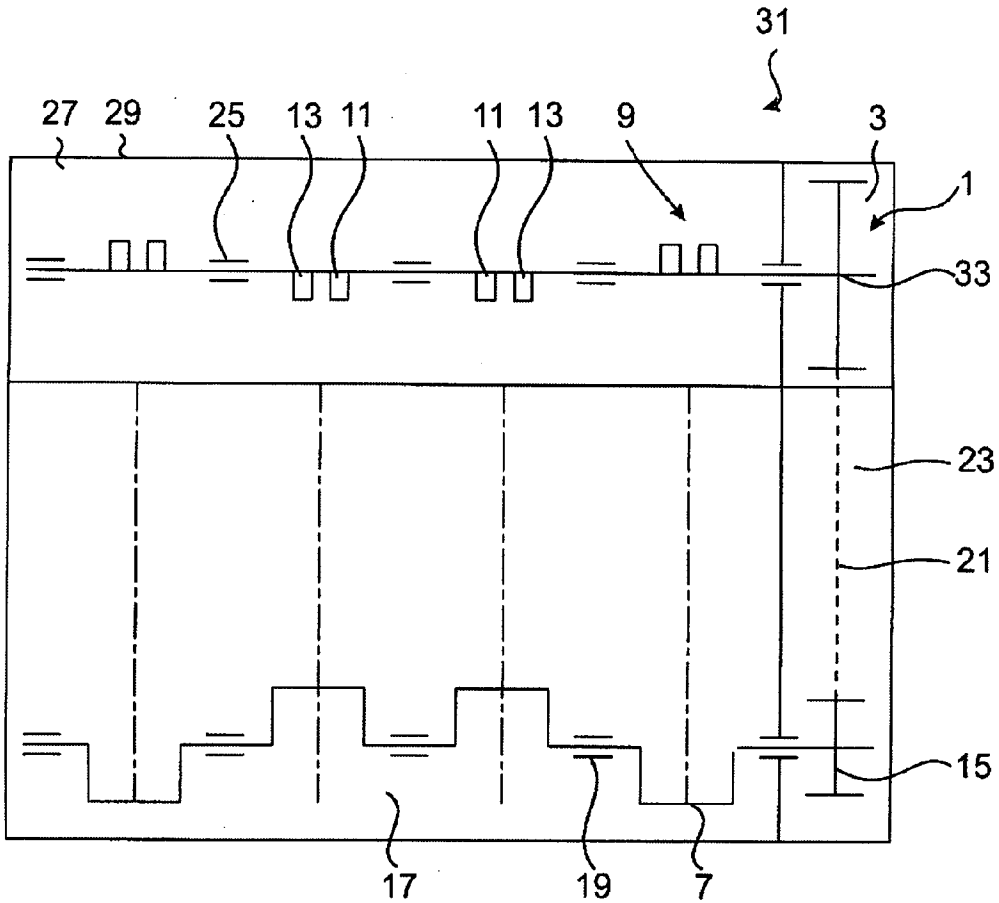
FIG. 1B shows a schematically presented and abstracted cross section through an engine block.
Figure 1A:
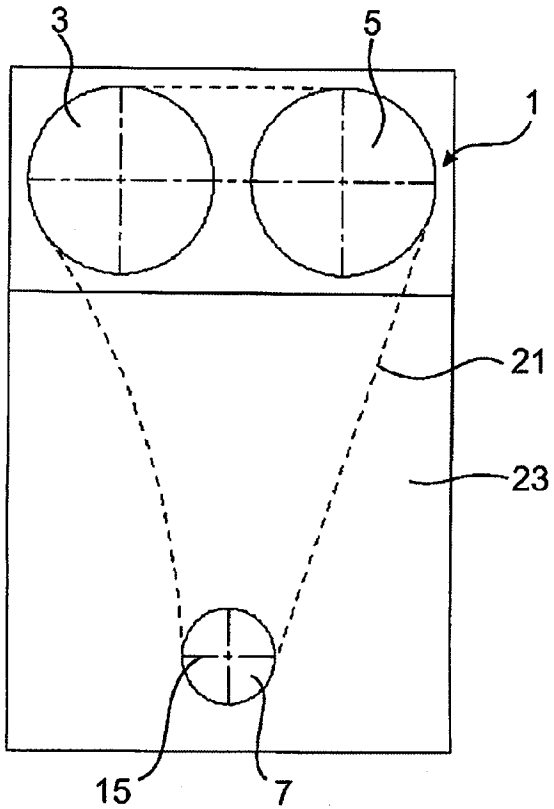
FIG. 1A shows a front view of a schematically presented engine block with open chain drive case.

FIG. 1A shows the schematically presented open chain case 23, in which the driven means 21, i.e., the chain, assures a drive-type connection between a reference shaft 7 and at least one of the camshaft adjusters 3, 5. The camshaft adjuster 3 is part of the valve train 1. The camshaft adjuster 5 is also part of the valve train 1. The driven means 21 is engaged on reference shaft 7 and a flywheel 15 is present also on reference shaft 7 for bridging the non-powered kinetic phases of the rotating reference shaft 7. A translation takes place between reference shaft 7, which, for example, is a crankshaft, and one of the two camshaft adjusters 3, 5, ideally both camshaft adjusters 3, 5. If the cross-sectional representation of the engine block 31 is examined in FIG. 1B, then the structure of valve train 1 can be seen more closely. The reference shaft 7, which is the crankshaft, is mounted in crankcase 17 by means of crankshaft bearing 19. The flywheel 15 is engaged at one end of the reference shaft 7. The flywheel 15 stores and delivers kinetic energy from the crankshaft. For the synchronized transfer of the rotary motion of the crankshaft, the engine block 31 has a driven means 21, which produces a mechanically solid connection between camshaft adjuster 3 and reference shaft 7 in a driven means case such as a chain case 23. In the lower-lying crankcase 17, the crankshaft rests on crankshaft bearing 19. The camshaft is designed as a double camshaft 9. The camshaft 9 lies in the camshaft bearing 25 in the cylinder head 27. The camshaft, in the form of the double camshaft 9 lies underneath a cylinder head cover 29. Due to the double design of the double camshaft 9, two different sets of cams 11, 13 can be controlled differently relative to one another. Therefore, the inlet properties of the inlet gas-exchange valves can be controlled by one camshaft by means of cams 11, and the outlet properties of the outlet gas-exchange valves can be controlled by one camshaft by means of cams 13. If a variable valve train 1 is involved, then the relative references between cams 11 and cams 13 can be adjusted relative to a reference point such as the reference shaft 7. Whereas the driven means 21 engages at the outer periphery of the camshaft adjuster 3, the driven force is discharged from the camshaft adjuster 3 via the camshaft adjuster center 33 onto the double camshaft 9. For this purpose, a connection between double camshaft 9 and camshaft adjuster 3 is to be produced in such a way that a reliable connection results, which shall be made possible easily, rapidly and with few working steps. A parallel design of the components to be joined or of the components to be rotated, in addition, shortens the assembly time.

Figure 2:
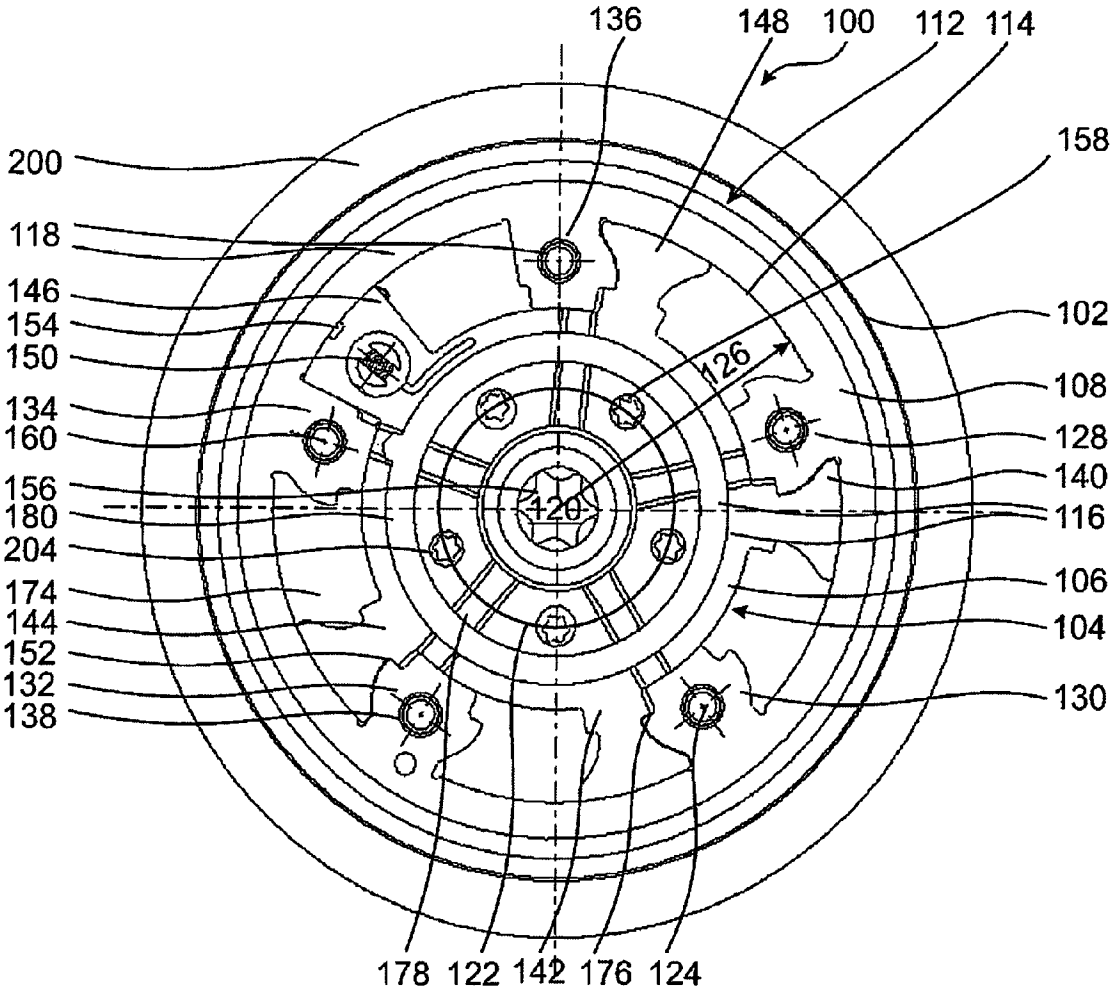
FIG. 2 shows a first example of embodiment of the present invention, sectioned through the camshaft adjuster.
Figure 3:
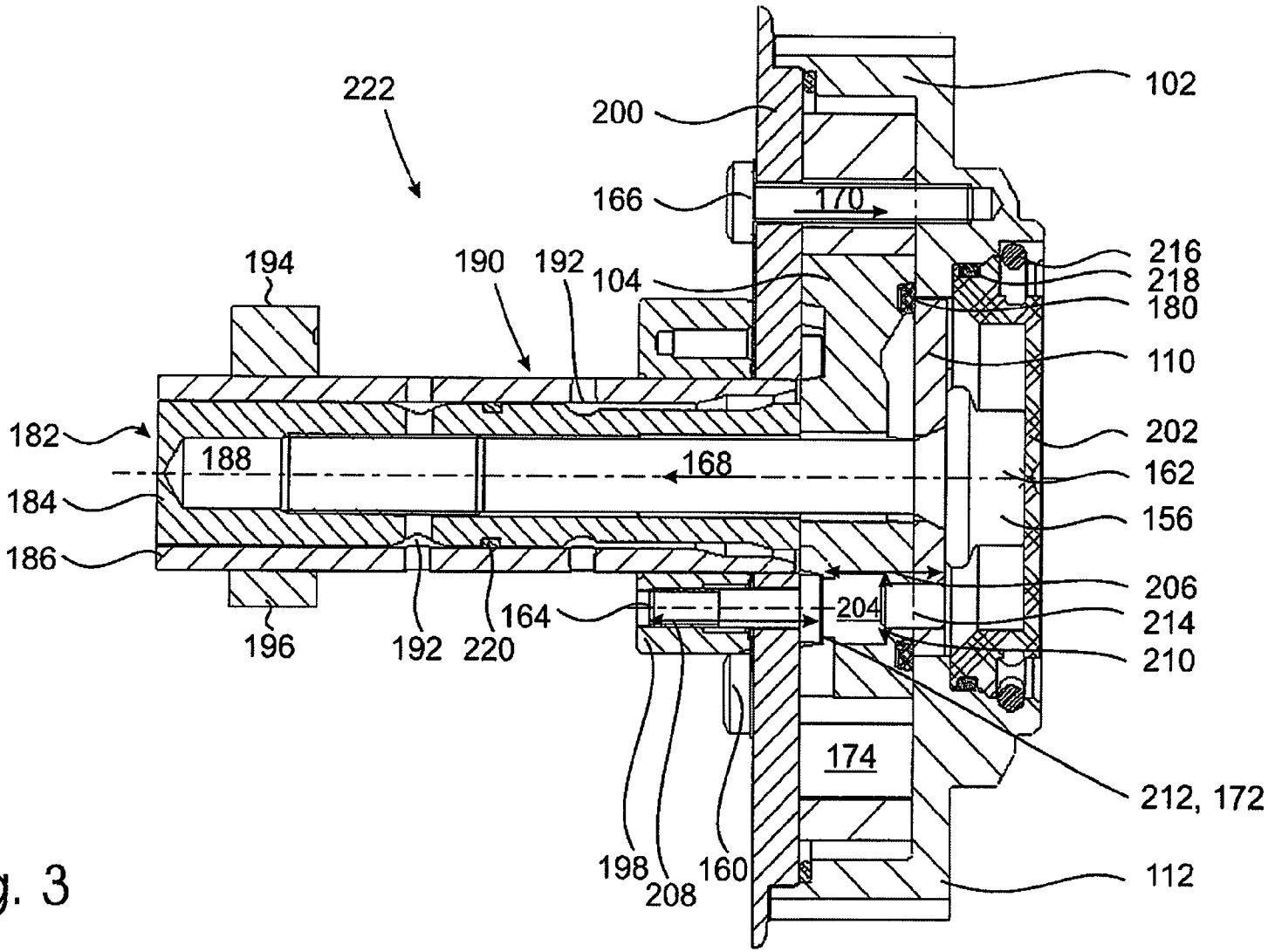
FIG. 3 shows the first example of embodiment of the present invention, sectioned through the rear part of the valve train.

FIG. 2 shows a first example of embodiment of a camshaft adjuster 100 in accordance with the present invention. Camshaft adjuster 100 is part of the valve train 1 according to FIGS. 1A and 1B, together with the camshaft that is shown in FIG. 3 as double camshaft 182. FIG. 2 shows a section through the camshaft adjuster 100 for the first example of embodiment; FIG. 3 shows a longitudinal section through the valve train 222. The camshaft adjuster 100 is part of the valve train 222. In addition, the double camshaft 182 and the connection means such as the connection means 156, 158, 160 belong to the valve train. The double camshaft 182 is composed of a first camshaft 184 and a second camshaft 186. One of the two camshafts 184, 186, i.e., the first camshaft 184, is designed as the inner camshaft within the second camshaft 186. First cam 194 and second cam 196 lie on the outer camshaft 186. The cams 194, 196 may lie next to one another (not shown in FIG. 3).

In an alternative embodiment, as shown in FIG. 3, cams 194, 196 as well as double cams engaging in one another can be disposed so as to create two downstream events for a gas-exchange valve. One of the cams 194 follows the rotational movement of one of the camshafts 184 or 186, while the other cam 196 follows the rotational movement of the other camshaft 186 or 184. The camshaft adjuster 100 is a camshaft adjuster of the rotary vane type. The camshaft adjuster 100 has a stator 102 and a rotor 104. The stator 102 also rotates synchronously relative to the reference shaft (however, optionally, with a different rpm), which is shown as reference shaft 7 in the form of the crankshaft in FIG. 1B. The stator 102 comprises the rotor 104 in its stator housing 108. The rotor 104 is composed of rotor core 106 and vanes 140, 142, 144, 146 and 148 proceeding from rotor core 106. The camshaft adjuster 100 has approximately the same number of stator vanes 128, 130, 132, 134, 136 as rotor vanes 140, 142, 144, 146, 148. For example, a camshaft adjuster having several rotor vanes 140, 142, 144, 146, 148, such as, for example, five rotor vanes 140, 142, 144, 146, 148 is employed.

The rotor vanes 140, 142, 144, 146, 148, together with stator vanes 128, 130, 132, 134, 136, which are also designated as stator crosspieces, form chambers 174, 176 between them. The chambers 174, 176 appear several times in the camshaft adjuster 100. To the extent that one of the chambers 174 increases in size due to a hydraulic loading, the size of the other chamber 176 decreases. A relative position of the rotor 104 to the stator 102 is established between the vanes 140, 142, 144, 146, 148 and 128, 130, 132, 134, 136 due to hydraulic pressure. The stator 102 is composed not only of the stator housing 108, but other components, such as, for example, an insert plate 110 (see FIG. 3), also belongs to the stator 102, in order to create an external, enveloping part 112 (see FIGS. 2 and 3) of the camshaft adjuster 100. The stator 102 is trough-like in order to take up the rotor 104 in its middle part.

The stator 102 is configured as rotatory. Different rims 122, 124 along the radius 126 of the camshaft adjuster 100 (seen virtually) can be associated therewith. The camshaft adjuster 100 has a center 120, which can be subtracted from the radius 126. Radii that are designated as first rim 122 and as second rim 124 are formed on radius 126. The second rim lies beyond the first rim 122, e.g., it has at least double the circumference of the first rim 122. The camshaft adjuster 100 has different connection means 156, 158, 160. The connection means 156, 158, 160 lie inside a maximum radius 126, which is defined by the inner wall 114 of the stator 102. The connection means 156, 158, 160 take over different tasks. A first connection means 156, in a force-fitting manner, produces the connection between rotor 104, more precisely rotor core 106, and one of the camshafts 184, 186. Ideally, the inner camshaft 184 is joined to the rotor 104 via the connection means 156. The other connection means 158 (see FIG. 2), which appears several times in the camshaft adjuster 100, is provided as screw 164 (see FIG. 3). Thus, the rotor 104, together with additional components, such as, for example, a hydraulic-fluid channel cover 180 forms a first set 116 of rotatable components. Since the stator 102 also executes a rotating movement during the operation of the internal combustion engine, i.e., of the engine block 31 (see FIG. 1B), the stator 102, together with additional components, such as the insert plate 110 and the drive wheel 200, form a second set 118 of rotatable components. The torque from the reference shaft 7, which is introduced hydraulically via the rotor core 106, is transferred onto the connection means 156 disposed in the center 120 of the camshaft adjuster 100. For a particularly good force transfer, the connection means 156 is designed as a first, large screw 162, which preferably lies in the center of the valve train 222, thus in the center 120 of the camshaft adjuster 100.

In the case of hydraulic undersupplies in the chambers 174, 176, a fastening means 150 for the positionally rigid fixation of the rotor 104 to the stator 102 is in a locked position. In order to increase the sealing effect between the individual chambers 174, 176, sealing strips 154 can be provided in individual vanes 146. With a suitably precise manufacture, the sealing strips 154 may be omitted in most vanes. Since the stator 102 is composed of several parts such as the stator housing 108 and the drive wheel 200, additional connection means, third connection means 160, must brace the individual, enveloping parts 112 of the camshaft adjuster 100. For this purpose, the stator vanes 128, 130, 132, 134, 136 have special recesses 138, so that the connection means 160 of the third type can pass through and engage from one part of the stator 102 into the other part of the stator 102. Offset relative to the connection means 160, the connection means 158 of the second type are placed in the camshaft adjuster 100, oriented further in the direction to the center 120. The connection means 158 all lie on rim 122 of rims 122, 124, which are enclosed by the inner wall 114 of the stator. The recess 138 lies approximately in the middle of the stator vane 132. For the supply of the chambers 174, 176, hydraulic-fluid channels 178 are made in the rotor 104, and these channels are protected against leakage at transition regions between the first set of rotatable components 116 and the second set 118 of rotatable components by additional hydraulic-fluid channel covers 180 that produce the seals. The connection means 158 of the second type lying on the rim 122 open up into free cut spaces 204. It is particularly advantageous if the individual connection means 156, 158, 160 are produced by screw connections by means of screws 162, 164, 166. It is particularly advantageous if at least one screw 166 of the screws 162, 164, 166 has an orientation that is different than the remaining screws 162, 164. The orientation 170 of the screws 166 runs anti-parallel to the orientation 168 of the largest screw 162, which joins the rotor 102 with the double camshaft 182 on its end 190 by screwing onto the inner camshaft 184. The double camshaft 182 has a mounting flange 198, in which the screws 164 of the second type can be screwed in.

As can be seen in FIG. 2, the connection means 158 are spaced apart uniformly, thus distributed at the same angle over the rotor 102 onto a rim 122 within the rotor. For a quieter assumption of the final rotor position of the rotor 104 to the stator 102, end-of-travel cushioning members 152 are integrated into the stator vanes 128, 130, 132, 136 as well as into the rotor vanes 140, 142, 144, 146, 148. The connection means 160 also lie in the stator vanes 128, 130, 132, 134, 136. The second rim 124, as a closed curve that is circular, intersects both the approximate middle of the stator vanes 128, 130, 132, 134, 136 as well as the approximate middle of the rotor vanes 140, 142, 144, 146, 148. The position of the fastening means 150 also lies on the second rim 124. Thus, the end 190 of the camshaft in the form of the double camshaft 182 can be reliably joined to the camshaft adjuster 100, if the axis 188 of the double camshaft 182 is extended in its length by the first screw 162. The screw 162 opens up into the cover 202, which creates a hydraulically sealed camshaft adjuster 100 by means of a seal 216, such as, for example, an O-ring seal. The hydraulic seal is made possible not only by the cover 202, but also by the bracing force of screws 166 of the third type. The two camshafts 184, 186 coincide with the axis 188 of the double camshaft 182. The end of the inner camshaft 184 is drilled hollow so that the first screw 162 can be screwed therein. Along screw 162 and beyond, between the two camshafts 184, 186, are found channels for further conducting the hydraulic fluid from the bearing channels 192 up to the chambers 174, 176. The first screw 162, which is the largest screw of the camshaft adjuster 100, thus lies in part in the hydraulic fluid, which is specified for one of the two chambers 174, 176. The other set 118 of rotatable components, which form the stator components of the stator 102, can be joined to the second camshaft 186 of the double camshaft 182; the screws 164 of the second type can be inserted at selected places through the rotor core 106 and screw a part of the stator 102, such as the drive wheel 200, directly and without intermediate means, to the mounting flange 198. For this purpose, free cut spaces 204 corresponding to the number of screws 164 are provided in the camshaft adjuster 100. The screw 164 has a certain length 208. The free cut space 204 has a length 206. The length 206 of the free cut space 204 is adapted to the length 208 of the screw 164, so that the front end of the screw 164, which rests in the mounting flange 198 when it is screwed in, can be completely pulled out of the mounting flange. For this purpose, the camshaft adjuster 100 has internal guide channels 214, which can be closed by the cover 202, finally hydraulically sealed tightly after the assembly process. Also, the width 210 of the free cut space 204 is adapted to the width 212 of the connection means. Thus, the head 172 of the connection means can be pulled back into the rear part of the free cut space 204.

Due to the narrow-mouth configuration of the guide channel 214, the guide channel 214 is narrower than the normal width 210 of the free cut space 204, and thus narrower than the width 212 of the connection means; it cannot be lost when the camshaft adjuster 100 is detached from the mounting flange 198 of the double camshaft 182. If the camshaft adjuster 100 is assembled, then fastening screws 164 for the mounting flange 198 are placed in each free cut space. The camshaft adjuster 100 is held together in its compact form by the screws 166 of the third type. The screws 166 brace the drive wheel 200 to another part of the stator 102, such as the stator trough. When the camshaft adjuster 100 is mounted on the double camshaft 182, in order to form a valve train 222, one of the two screw types 162, 164 can be joined alternately to one of the two camshafts 184, 186. The camshaft adjuster 100 thus is mounted on the double camshaft 182 after the first fastening step, but the double camshaft can still be adjusted with respect to the exact cam position of the cams 194 relative to the cams 196 of the second type. For this purpose, a fastening tool, such as a torque wrench, engages through the guide channels 214 into the respective heads 172 of the screws 164. The head 172 of the connection means specific for the mounting flange 198 is broader in its width 212 than the guide channel 214 but slightly narrower than the width 210 of the free cut space 204. Numerous seals 216, 218, 220 and components such as the hydraulic-fluid channel cover 180 with a sealing function are placed in the valve train 222, in order for the hydraulic fluid to flow, as much as possible without loss, along the channels, such as the bearing channel 192, into the chambers, such as chamber 174. Thus the cover 202 to be introduced subsequently can further reduce the leakage of the camshaft adjuster 100; at least one seal 216, ideally two seals 216, 218, is or are inserted into the cover 202 between stator housing 208 and cover 202. One of the seals 216, 218 can simultaneously be designed as a snap ring or spring seal in order to brace the cover 202 with the stator housing 108 in a snap-in manner. Despite the three screws 162, 164, 166 lying within circles, the camshaft adjuster 100 does not need to be much longer than comparable camshaft adjusters which are provided only for single camshafts instead of a double camshaft 182. The compact form of the camshaft adjuster 100 can be retained, although it can control a double camshaft 182. The circumstance is produced, inter alia, in that the free cut space 204 is disposed parallel to one chamber 174.

Figure 4:
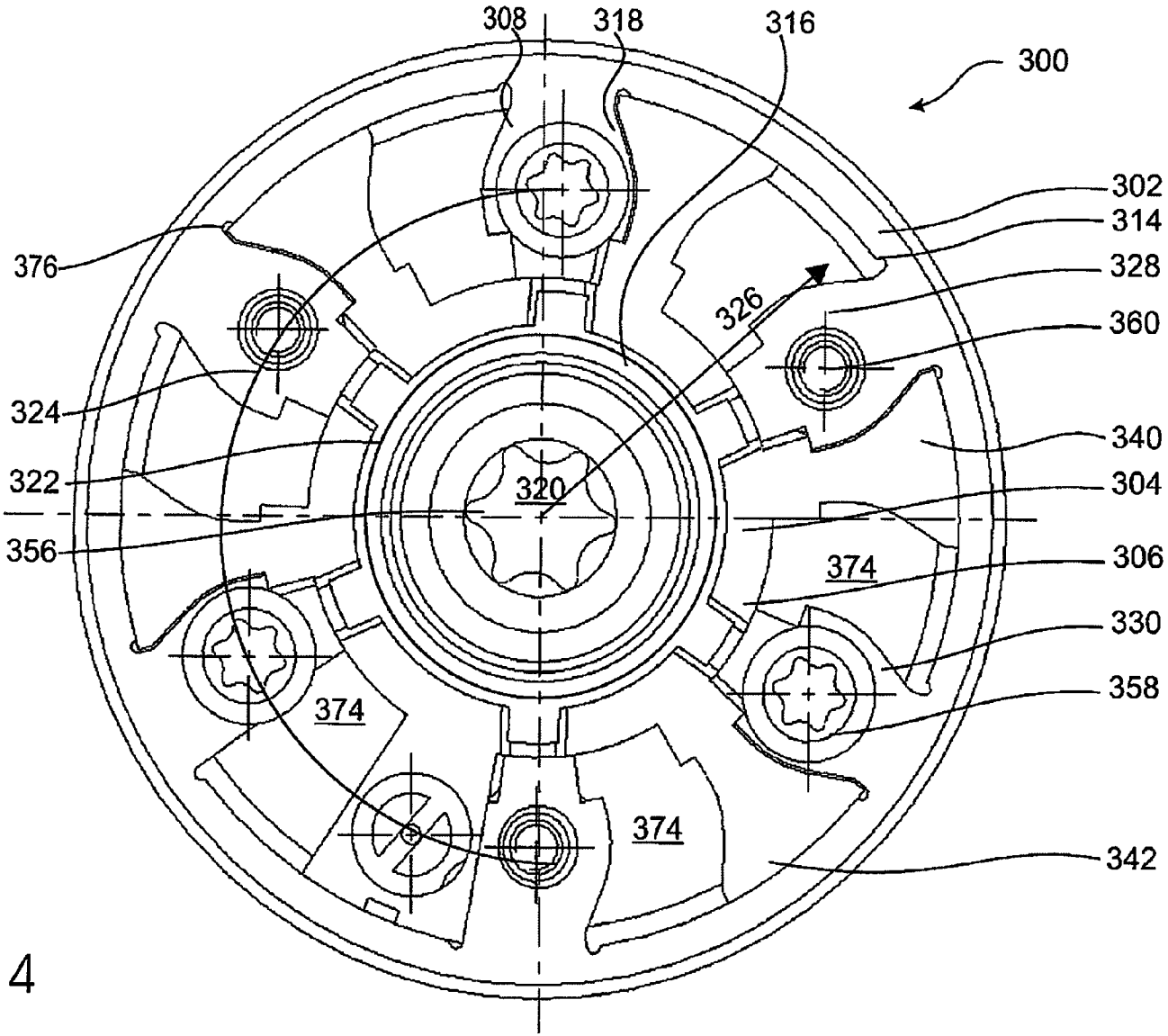
FIG. 4 shows a second example of embodiment of the present invention, sectioned through the camshaft adjuster.

FIG. 4 shows another embodiment of a camshaft adjuster 300. The camshaft adjuster 300 comprises a stator 302 and a rotor 304. Rotor 304 is enclosed by the stator 302. The rotor 304 is bounded by the inner wall 314 of the stator 302 so that individual chambers 374, which are specified for the uptake of hydraulic fluids, can form several times between rotor 304 and stator 302. For each chamber 374 there is a corresponding chamber 376, which is reduced to a minimum when chambers 374 are maximally pivoted. As can be recognized in FIG. 4, the camshaft adjuster 300 is arranged around a center 320, and thus the individual rotor vanes 340, 342 are joined to the rotor core 306. The rotor 304 is mounted around center 320 so that it can rotate between stator vanes 328, 330. Stator 302 and rotor 304 are sealed by three sets of different connection means 356, 358, 360, to form a hydraulically sealed unit. For this purpose, individual rims 322, 324 can be formed, which are to be considered as outer boundaries of the arrangement of the connection means 356, 358, 360. The rims 322, 324 are arranged around the center 320. The rims 322, 324 are centered relative to center 320. Two of the three types of connection means 356, 358, 360 lie on the same rim 324. The two connection means 358, 360, however, are oriented differently. Connection means 356, which passes through the center 320 of the camshaft adjuster 300, serves as the central fastening means. The camshaft adjuster 300 can thus be designated as the central screw camshaft adjuster. Based on the mounting of the camshaft adjuster 300 by means of its centrally disposed connection means 356, the camshaft adjuster 300 can also be considered a hydraulic consumer with two sets of rotatable components 316, 318. The stator housing 308 belongs to the second set of rotatable components. In the camshaft adjuster 300, the connection means 356, 358, 360 are placed on individual radii along a radius 326 away from the center. In this case, the connection means 358, 360 are arranged alternately on the same radius of the rim 324, i.e., a connection means 358 is followed by a connection means 360, after which another connection means 358 follows. A surface pressure that is as uniform as possible is facilitated by this measure, which contributes to the sealing of the camshaft adjuster 300.

Figure 5:
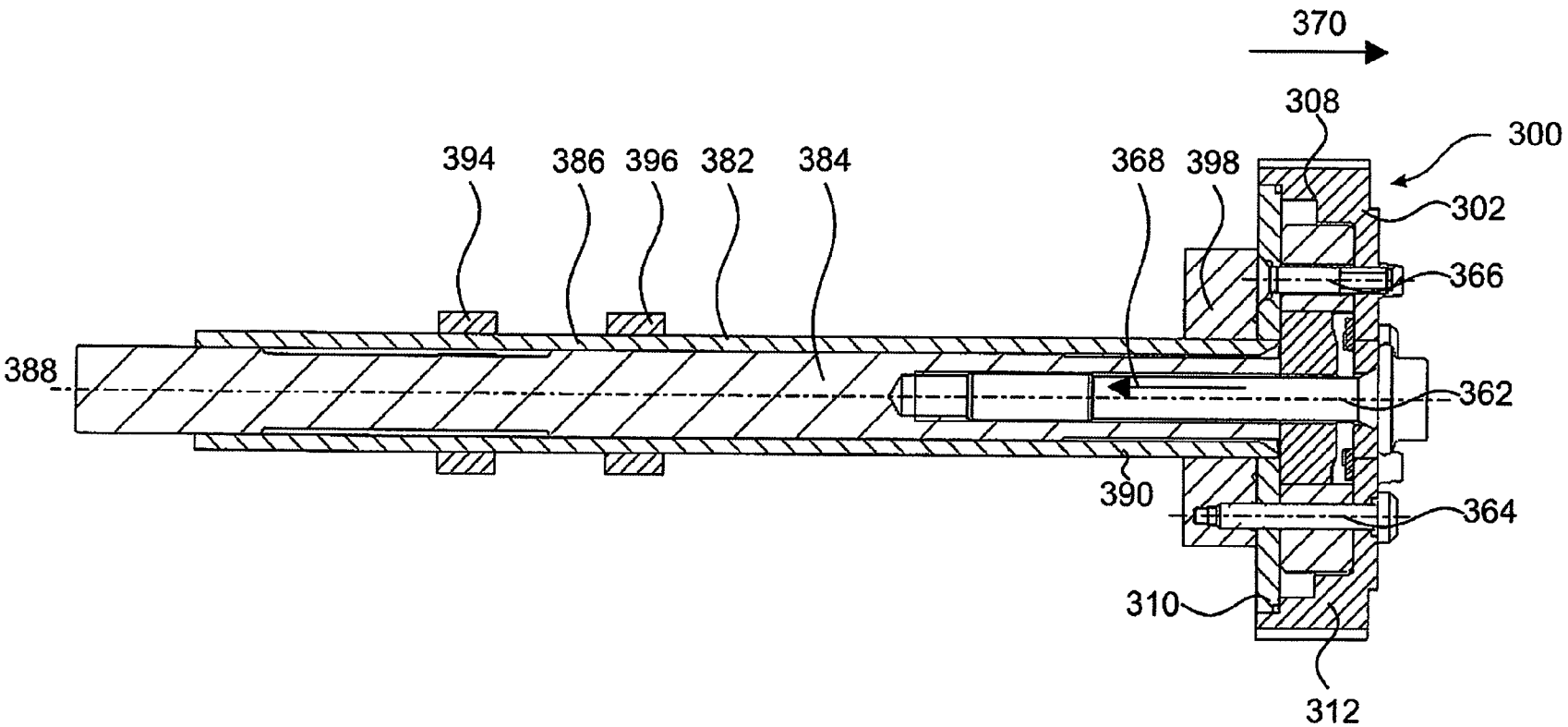
FIG. 5 shows the second example of embodiment of the present invention, sectioned through the rear part of the valve train.

In FIG. 5, the camshaft adjuster 300 together with a camshaft configured as a double camshaft 382 is depicted in longitudinal section. Different cams 394, 396, actually sets of cams 394, 396, are introduced, for example, shrunk, in a rotationally fixed connection, onto double camshaft 382, which is composed of the two camshafts 384, 386. The camshaft adjuster 300, together with the double camshaft 382, rotates around a centrally disposed axis 388. The camshaft adjuster 300 is attached by a first screw 362 to one end 390 of the camshaft 382. The camshaft 382 offers a mounting flange 398. Additional screws 364, 366 are disposed parallel to the central screw 362. The screws 364 extend through the stator housing 308 and fasten the stator housing 308 to the mounting flange 398. In orientation 370 which is the reverse of this, the screws 366 are arranged for holding together the camshaft adjuster 300. The central screw 362 is aligned with its orientation 368 on the camshaft 382. In this way, the thread of the screw 362 can bring at least one camshaft of the double camshaft 382, preferably the inner camshaft 384, into a rotational attachment with the stator housing 308. The trough-type housing 308 of the stator 302 is part of an enveloping member 312 of the camshaft adjuster 300 on the lateral side of an insert plate 310. All of screws 362, 364, 366 pass through the enveloping member 312.

Figure 6:
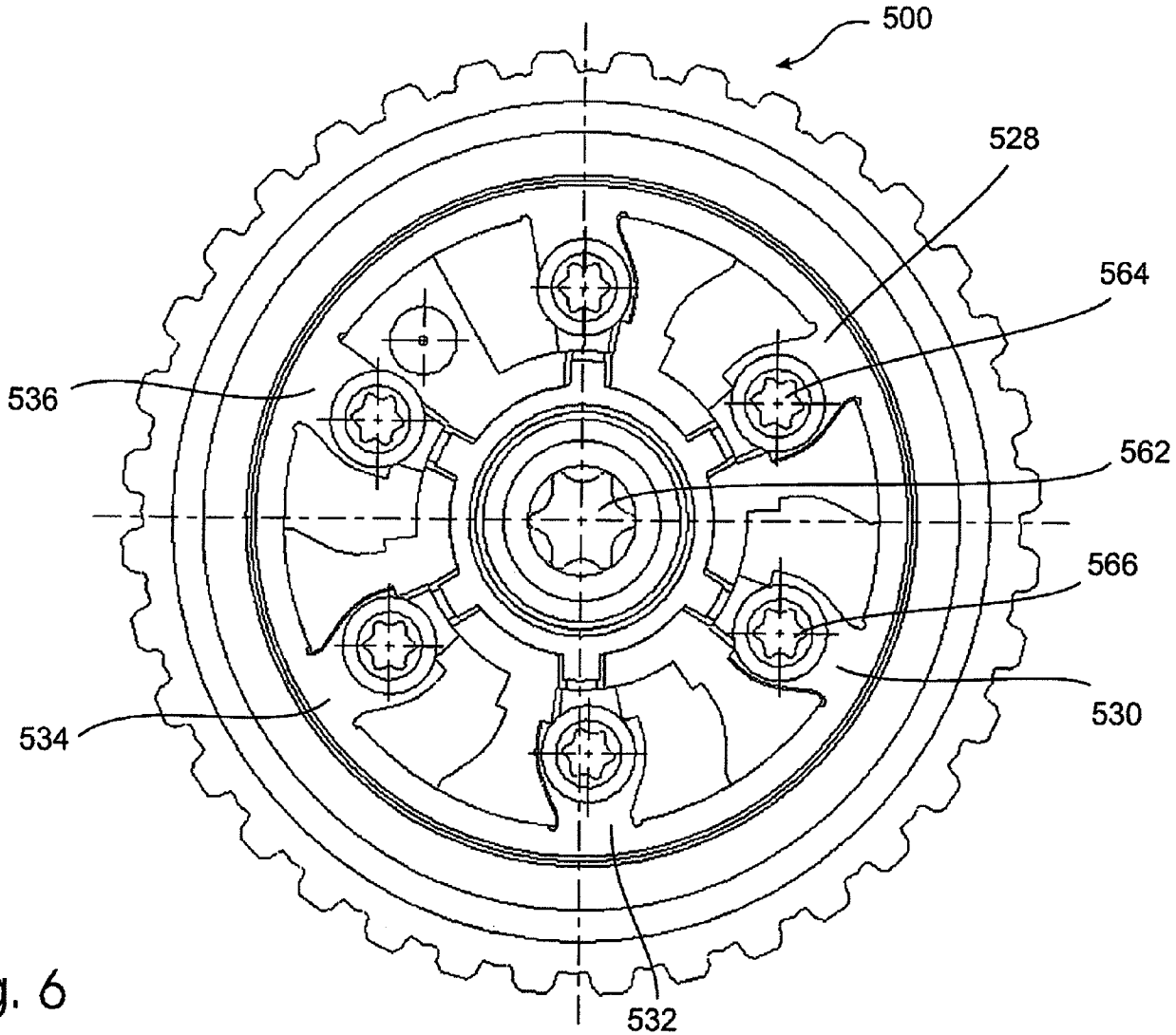
FIG. 6 shows a third example of embodiment of the present invention, sectioned through the camshaft adjuster.
Figure 7:
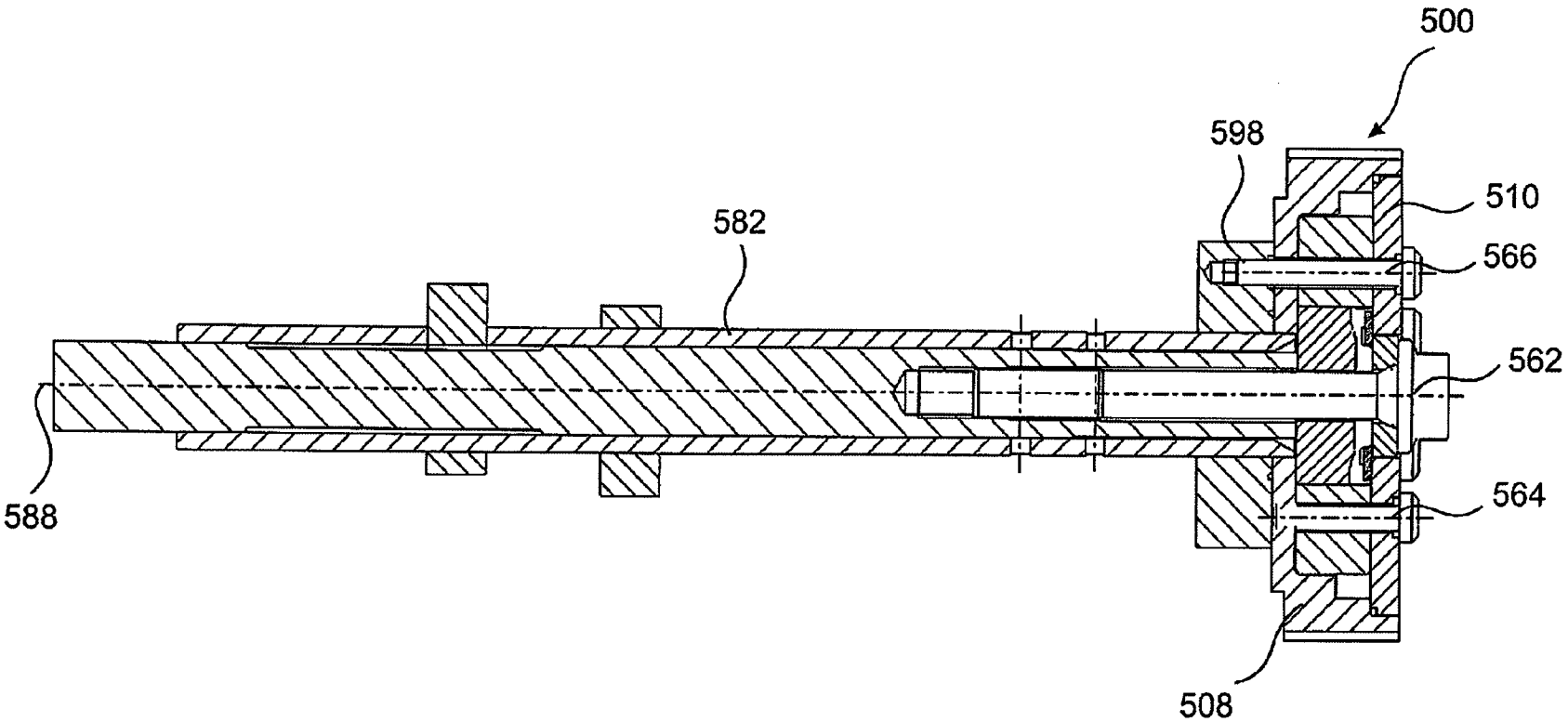
FIG. 7 shows the third example of embodiment of the present invention, sectioned through one end of the valve train.

Another example embodiment can be seen in the two FIGS. 6 and 7. The camshaft adjuster 500 is attached by means of a first screw 562 in the axial extension of the central axis 588. The central axis passes through both the camshaft adjuster 500 as well as through the camshaft 582, which is configured as a camshaft in duplicate, thus as a double camshaft. The camshaft adjuster 500 has three different types of screws 562, 564, 566. The stator housing 508 is shaped like a trough and takes up its own plate 510 in its trough-like inside space. The screws of type 564 and 566 are disposed alternately in the stator vanes 528, 530, 532, 534, 536. The camshaft adjuster 500 has six stator vanes 528, 530, 532, 534, 536. Thus, three screws of the type 564 and three screws of the type 566 are each screwed into the camshaft adjuster 500 in alternating arrangement in turn on a common radius. While screws 566 extend into the mounting flange 598, the screws 564 hold together the camshaft adjuster 500. Oil conducting channels are disposed around one of the screws 562. All screws 562, 564, 566 are aligned in the same direction parallel to the central axis 588 in the configuration according to FIG. 7.

Figure 8:
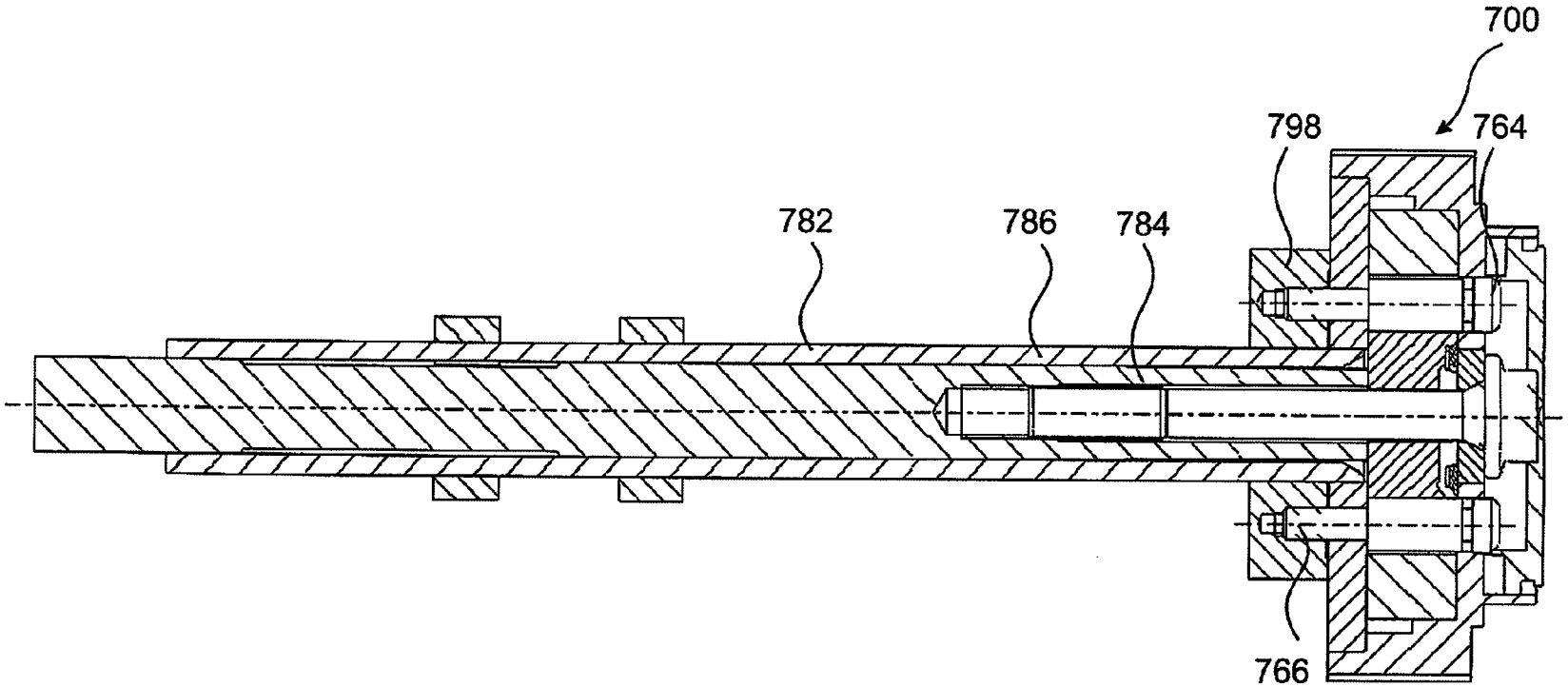
FIG. 8 shows a fourth example of embodiment of the present invention, sectioned through one end of the valve train.
Figure 9:
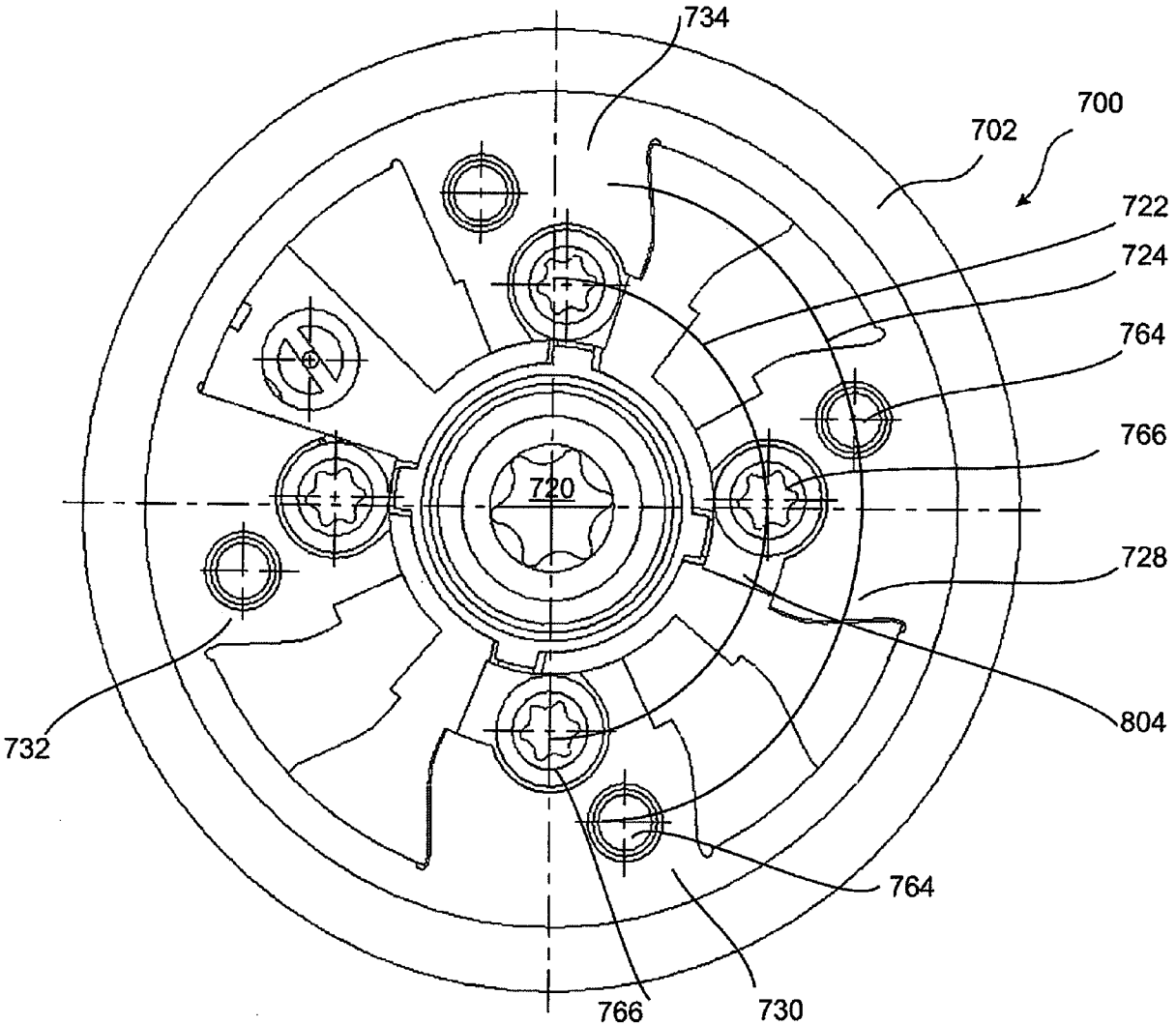
FIG. 9 shows the fourth example of embodiment of the present invention, sectioned through the camshaft adjuster.

As can be derived from the further example embodiment shown in the two FIGS. 8 and 9, screws 764, 766 can be disposed each on their own rim 722, 724 in a camshaft adjuster 700. In this arrangement, the screws 766 lie in a free cut space 804, which is provided especially for them, and this space is disposed closer to the center 720 of the camshaft adjuster 700. Stator vanes 728, 730, 732, 734 have special recesses for this. While the screws 764 are responsible for holding together the camshaft adjuster 700, screws 766 fasten the stator 702 of the camshaft adjuster 700 to the annular mounting flange 798 of one of the two camshafts 784, 786 of the camshaft designed as the double camshaft 782. The outer camshaft 786 is widened at one end and forms the annular flange 798.

It should now be appreciated that the present invention provides advantageous embodiments of a camshaft adjuster.

Although the invention has been described in connection with various illustrated embodiments, numerous modifications and adaptations may be made thereto without departing from the spirit and scope of the invention as set forth in the claims.

List of Reference Characters

| Reference character | Meaning |
|---|---|
| 1 | Valve train |
| 3 | Camshaft adjuster |
| 5 | Camshaft adjuster |
| 7 | Reference shaft, e.g. crankshaft |
| 9 | Double camshaft |
| 11 | Cam of the first type |
| 13 | Cam of the second type |
| 15 | Flywheel |
| 17 | Crankcase |
| 19 | Crankshaft bearing |
| 21 | Driven means such as a chain drive or belt drive |
| 23 | Chain case |
| 25 | Camshaft bearing |
| 27 | Cylinder head |
| 29 | Cylinder head cover |
| 31 | Engine block |
| 33 | Camshaft adjuster center |
| 100 | Camshaft adjuster |
| 102 | Stator |
| 104 | Rotor |
| 106 | Rotor core |
| 108 | Stator housing |
| 110 | Insert plate |
| 112 | Outer, enveloping part of the camshaft adjuster |
| 114 | Inner wall of the stator |
| 116 | First set of rotatable components |
| 118 | Second set of rotatable components |
| 120 | Center of the camshaft adjuster |
| 122 | First rim |
| 124 | Second rim |
| 126 | Radius, particularly inside the camshaft adjuster |
| 128 | First stator vane or first stator crosspiece |
| 130 | Second stator vane or second stator crosspiece |
| 132 | Third stator vane or third stator crosspiece |
| 134 | Fourth stator vane or fourth stator crosspiece |
| 136 | Fifth stator vane or fifth stator crosspiece |
| 138 | Recess, particularly in the crosspieces |
| 140 | First rotor vane |
| 142 | Second rotor vane |
| 144 | Third rotor vane |
| 146 | Fourth rotor vane |
| 148 | Fifth rotor vane |
| 150 | Fastening means such as a locking pin |
| 152 | End-of-travel cushioning members |
| 154 | Sealing strips |
| 156 | Connection means of the first type |
| 158 | Connection means of the second type |
| 160 | Connection means of the third type |
| 162 | First screw |
| 164 | Second screw |
| 166 | Third screw |
| 168 | Orientation of the connection means of the first type |
| 170 | Orientation of the connection means of the third type |
| 172 | Head of the connection means |
| 174 | First chamber |
| 176 | Second chamber |
| 178 | Hydraulic-fluid channel |
| 180 | Hydraulic-fluid channel cover |
| 182 | Double camshaft |
| 184 | First camshaft, in particular the inner camshaft |
| 186 | Second camshaft, in particular the outer camshaft |

-continued

| Reference character | Meaning |
|---|---|
| 188 | Axis, particularly of the camshaft |
| 190 | End of the camshaft |
| 192 | Bearing channel |
| 194 | First cam |
| 196 | Second cam |
| 198 | Mounting flange |
| 200 | Drive wheel |
| 202 | Cover |
| 204 | Free cut space |
| 206 | Length of the free cut space |
| 208 | Length of the connection means, particularly of the second type |
| 210 | Width of the free cut space |
| 212 | Width of the connection means, particularly of the second type |
| 214 | Guide channel of the free cut space |
| 216 | First seal |
| 218 | Second seal |
| 220 | Third seal |
| 222 | Valve train |
| 300 | Camshaft adjuster |
| 302 | Stator |
| 304 | Rotor |
| 306 | Rotor core |
| 308 | Stator housing |
| 310 | Insert plate |
| 312 | Outer, enveloping member of the camshaft adjuster |
| 314 | Inner wall of the stator |
| 316 | First set of rotatable components |
| 318 | Second set of rotatable components |
| 320 | Center of the camshaft adjuster |
| 322 | First rim |
| 324 | Second rim |
| 326 | Radius, particularly inside the camshaft adjuster |
| 328 | First stator vane or first stator crosspiece |
| 330 | Second stator vane or second stator crosspiece |
| 340 | First rotor vane |
| 342 | Second rotor vane |
| 356 | Connection means of the first type |
| 358 | Connection means of the second type |
| 360 | Connection means of the third type |
| 362 | First screw |
| 364 | Second screw |
| 366 | Third screw |
| 368 | Orientation of the connection means of the first type |
| 370 | Orientation of the connection means of the third type |
| 374 | First chamber |
| 376 | Second chamber |
| 382 | Double camshaft |
| 384 | First camshaft, in particular the inner camshaft |
| 386 | Second camshaft, in particular the outer camshaft |
| 388 | Axis, particularly of the camshaft |
| 390 | End of the camshaft |
| 394 | First cam |
| 396 | Second cam |
| 398 | Mounting flange |
| 500 | Camshaft adjuster |
| 508 | Stator housing |
| 510 | Cover plate, such as an insert plate |
| 528 | First stator vane or first stator crosspiece |
| 530 | Second stator vane or second stator crosspiece |
| 532 | Third stator vane or third stator crosspiece |
| 534 | Fourth stator vane or fourth stator crosspiece |
| 536 | Fifth stator vane or fifth stator crosspiece |
| 562 | First screw, particularly the central screw |
| 564 | Second screw, particularly the bracing screw |
| 566 | Third screw, particularly the flange screw |
| 582 | Camshaft, in particular camshaft designed in duplicate |
| 588 | Axis, in particular central axis |
| 598 | Mounting flange |
| 700 | Camshaft adjuster |
| 702 | Stator |
| 720 | Middle or center of the camshaft adjuster |
| 722 | First rim |
| 724 | Second rim |
| 728 | First stator vane or first stator crosspiece, in particular with screw recess |
| 730 | Second stator vane or second stator crosspiece, in particular with screw recess |

-continued

| Reference character | Meaning |
|---|---|
| 732 | Third stator vane or third stator crosspiece, in particular with screw recess |
| 734 | Fourth stator vane or fourth stator crosspiece, in particular with screw recess |
| 764 | Screw, in particular for fastening to the (outer) camshaft |
| 766 | Screw, in particular for the formation of the camshaft adjuster |
| 782 | Camshaft, in particular a double camshaft |
| 784 | Inner camshaft |
| 786 | Outer camshaft |
| 798 | Fastening ring [annular mounting flange] |
| 804 | Free cut space |

What is claimed is:

1. A valve train, which can be varied in relation to a reference shaft, comprising:

two camshafts, designed as coaxially configured double camshafts having cam positions that can be varied relative to one another, a pivoting-rotor camshaft adjuster which in a center is fastened by a connection means that passes through the pivoting-rotor camshaft adjuster and engages to a first camshaft of the two camshafts, the first camshaft having a first set of rotatable components, wherein:

the connection means comprises one of a screw or a central valve, a maximum radius is formed by a rim-type mounting flange of a second camshaft of the two camshafts within which is disposed at least one additional connection means that passes through the pivoting-rotor camshaft adjuster and engages the rim-type mounting flange for the fastening of a second set of rotatable components, the at least one additional connection means comprises a screw, the first set of rotatable components comprises at least a rotor which together with at least one component of the second set of rotatable components forms hydraulic chambers, the second set of rotatable components comprises at least a stator, and the hydraulic chambers holding a free cut space for the at least one additional connection means in the rotor to be aligned axially to the double camshaft.

2. The valve train according to claim 1, wherein:

the rim-type mounting flange is formed in one piece on the second camshaft comprising an outer camshaft, and the rim-type mounting flange extends radially outward at one end of the second camshaft, in which several distributed screws engage for a force-fitting connection.

3. The valve train according to claim 1, wherein:

the free cut space is adapted in length for a complete removal of the connection means from the rim-type mounting flange, the diameter of the free cut space is larger than a widest portion of the connection means, and the free cut space transitions into a narrow-mouth guide channel for a manipulating means.

4. The valve train according to claim 1, wherein:

an outer, enveloping component of the pivoting-rotor camshaft adjuster is equipped with a free cut space in an oil chamber in which a portion of the at least one additional connection means is to be sunk during a joining phase of the pivoting-rotor camshaft adjuster with the two camshafts.

5. The valve train according to claim 1, wherein:

the at least one additional connection means is located within the maximum radius, which, running centrally in the pivoting-rotor camshaft adjuster, is smaller than an inner wall of the stator.

6. The valve train according to claim 1, wherein:

the at least one additional connection means is found in crosspiece-type sections of an enveloping member of the pivoting-rotor camshaft adjuster.

7. The valve train according to claim 6, further comprising:

at least one trough-type configured recess for widening the hydraulic chambers is present in the crosspiece-type sections, a head of the at least one additional connection means is adapted to rest in form-fitting fashion on a side associated with the double camshaft in the at least one trough-type configured recess.

8. The valve train according to claim 1, wherein:

at least two additional connection means are provided which are oppositely oriented.

* * * * *